US011898113B2

(12) United States Patent
Collier et al.

(10) Patent No.: US 11,898,113 B2
(45) Date of Patent: Feb. 13, 2024

(54) COMPOSITION FOR CLEANING COMBUSTION ENGINE SYSTEMS

(71) Applicant: Cataclean Global Ltd., Liverpool (GB)

(72) Inventors: Harold Collier, Hapton (GB); Antony Leigh, Hapton (GB)

(73) Assignee: Cataclean House, Liverpool (GB)

( * ) Notice: Subject to any disclaimer, the term of this patent is extended or adjusted under 35 U.S.C. 154(b) by 89 days.

(21) Appl. No.: 17/624,713

(22) PCT Filed: Jul. 7, 2020

(86) PCT No.: PCT/GB2020/051630
§ 371 (c)(1),
(2) Date: Jan. 4, 2022

(87) PCT Pub. No.: WO2021/005358
PCT Pub. Date: Jan. 14, 2021

(65) Prior Publication Data

US 2022/0243138 A1 Aug. 4, 2022

(30) Foreign Application Priority Data

Jul. 8, 2019 (GB) ..... 1909773

(51) Int. Cl.

| | |
|---|---|
| ***C10L 1/16*** | (2006.01) |
| ***C10L 1/182*** | (2006.01) |
| ***C10L 1/185*** | (2006.01) |
| ***C10L 10/18*** | (2006.01) |
| ***C10M 169/04*** | (2006.01) |
| ***C10N 30/04*** | (2006.01) |
| ***C10N 40/25*** | (2006.01) |

(52) U.S. Cl.
CPC ..... *C10L 1/1616* (2013.01); *C10L 1/1608* (2013.01); *C10L 1/1824* (2013.01); *C10L 1/1852* (2013.01); *C10L 10/18* (2013.01); *C10M 169/04* (2013.01); *C10M 2203/06* (2013.01); *C10M 2203/10* (2013.01); *C10M 2207/04* (2013.01); *C10N 2030/04* (2013.01); *C10N 2040/25* (2013.01)

(58) Field of Classification Search
CPC ..... C10L 1/1608; C10L 1/1616; C10L 1/18; C10L 1/1824; C10L 1/1852; C10M 169/04; C10M 2203/06; C10M 2203/10; C10M 2207/04; C10N 2030/04; C10N 2040/25
See application file for complete search history.

(56) References Cited

U.S. PATENT DOCUMENTS

| | | | | |
|---|---|---|---|---|
| 5,955,410 | A * | 9/1999 | Dingess | C11D 3/2079 134/40 |
| 2002/0116782 | A1 | 8/2002 | Bowsman et al. | |
| 2004/0142838 | A1* | 7/2004 | Azuma | C11D 1/66 510/285 |
| 2006/0142172 | A1* | 6/2006 | Cioletti | C11D 3/43 510/365 |
| 2012/0125445 | A1* | 5/2012 | Simpson-Green | C11D 1/721 137/15.05 |
| 2014/0000158 | A1 | 1/2014 | Gannon et al. | |

FOREIGN PATENT DOCUMENTS

| | | | | |
|---|---|---|---|---|
| CA | 2013431 | A1 | 9/1990 | |
| CN | 1412290 | A | 4/2003 | |
| CN | 103221526 | A | 7/2013 | |
| CN | 108659993 | A | 10/2018 | |
| CN | 108913392 | A | 11/2018 | |
| EP | 2640821 | B1 | 1/2019 | |
| JP | 06228598 | A * | 8/1994 | C11D 3/18 |
| JP | H06322393 | A | 11/1994 | |
| JP | 2001049294 | A * | 2/2001 | |
| WO | 2021005358 | A1 | 1/2021 | |

OTHER PUBLICATIONS

"Cataclean Petrol Fuel Additives"; Cataclean Ltd; Cataclean.com; https://www.cataclean.com/shop/cataclean-petrol/1; Mar. 21, 2019; 4 pgs.

* cited by examiner

*Primary Examiner* — James C Goloboy

(57) ABSTRACT

A composition for cleaning a combustion engine system. The composition comprises a hydrocarbon. The hydrocarbon comprises respective first and second hydrocarbons. The first hydrocarbon comprises a lubricant, wherein the lubricant has a flash point, measured according to ASTM D93, of less than 80° C. The second hydrocarbon comprises an aromatic hydrocarbon, wherein the aromatic hydrocarbon has a flash point, measured according to ASTM D93, of greater than 62° C. The composition further comprises an oxygen donor. The oxygen donor comprises respective first and second oxygen donors. The first oxygen donor comprises a hydroxyl group and has a flash point, measured according to ASTM D93, of from 45° C. to 95° C. The second oxygen donor comprises a carbonyl group or an ether group and has a flash point, measured according to ASTM D93, of from 50° C. to 120° C.

18 Claims, No Drawings

COMPOSITION FOR CLEANING COMBUSTION ENGINE SYSTEMS

CROSS-REFERENCE TO RELATED APPLICATION

This application is the National Stage of, and therefore claims the benefit of, International Application No. PCT/GB2020/051630 filed on Jul. 7, 2020, entitled "COMPOSITION FOR CLEANING COMBUSTION ENGINE SYSTEMS," which was published in English under International Publication Number WO 2021/005358 on Jan. 14, 2021, which claims the benefit of GB Application No. 1909773.2, filed Jul. 8, 2019. The above applications are commonly assigned with this National Stage application and are incorporated herein by reference in their entirety.

TECHNOLOGICAL FIELD

Examples of the disclosure relate to compositions for cleaning combustion engine systems, and particularly for cleaning combustion engine systems used to power vehicles and other devices.

BACKGROUND

Combustion engine systems are commonly used to power vehicles and other machines. In some examples, a combustion engine system comprises a fuel storage system, an internal combustion engine, a fuel injection system for introduction of fuel into the engine, a catalytic converter and an exhaust system.

Over time, deposits build up on these components which reduces performance of, and increases emissions from, the combustion engine system. Compositions are known which reduce or remove such deposits, but such compositions have a relatively low flash point, and are therefore hazardous to use and problematic to transport and store.

It is desirable therefore to provide cleaning compositions for combustion engine systems which have an increased flash point.

All proportions referred to in this specification are indicated as % by volume of the total composition, unless indicated otherwise.

BRIEF SUMMARY

According to various, but not necessarily all, examples of the disclosure there is provided a composition for cleaning a combustion engine system, wherein the composition comprises:

a hydrocarbon, wherein the hydrocarbon comprises respective first and second hydrocarbons, wherein the first hydrocarbon comprises a lubricant, wherein the lubricant has a flash point, measured according to ASTM D93, of less than 80° C., wherein the second hydrocarbon comprises an aromatic hydrocarbon, wherein the aromatic hydrocarbon has a flash point, measured according to ASTM D93, of greater than 62° C.; and an oxygen donor, wherein the oxygen donor comprises respective first and second oxygen donors, wherein the first oxygen donor comprises a hydroxyl group and has a flash point, measured according to ASTM D93, of from 45° C. to 95° C., and wherein the second oxygen donor comprises a carbonyl group or an ether group and has a flash point, measured according to ASTM D93, of from 50° C. to 120° C.

The composition may have a flash point, measured according to ASTM D93, of greater than 55° C. The composition may have a flash point, measured according to ASTM D93, of greater than 60° C., or may have a flash point, measured according to ASTM D93, of greater than 63° C., or may have a flash point, measured according to ASTM D93, of greater than 66° C., or may have a flash point, measured according to ASTM D93, of 70° C.

The first oxygen donor may comprise an individual chemical compound, or may comprise a plurality of different chemical compounds. The second oxygen donor may comprise an individual chemical compound, or may comprise a plurality of different chemical compounds.

The first oxygen donor may have from five to eight carbon atoms in an individual chemical compound.

The hydroxyl group may be a primary alcohol. The first oxygen donor may comprise a single hydroxyl group, which may be primary alcohol.

The first oxygen donor may have a flash point, measured according to ASTM D93, of from 50° C. to 93° C.

The first oxygen donor may have a flash point, measured according to ASTM D93, of at least 50° C., or may have a flash point, measured according to ASTM D93, of at least 55° C., or may have a flash point, measured according to ASTM D93, of at least 80° C., or may have a flash point, measured according to ASTM D93, of at least 90° C., or may have a flash point, measured according to ASTM D93, of 93° C.

The first oxygen donor may be selected from the group comprising: benzyl alcohol, 2-methylbutan-1-ol, 2-ethylbutan-1-ol, and 2-ethyl hexanol.

The first oxygen donor may comprise one or more of: benzyl alcohol, 2-methylbutan-1-ol, 2-ethylbutan-1-ol, or 2-ethyl hexanol. The first oxygen donor may comprise benzyl alcohol.

The first oxygen donor may be selected from the group consisting of: benzyl alcohol, 2-methylbutan-1-ol, 2-ethylbutan-1-ol, and 2-ethyl hexanol.

The first oxygen donor may be benzyl alcohol, or may consist of benzyl alcohol.

The second oxygen donor may have from five to eight carbon atoms in an individual chemical compound. The second oxygen donor may have from one to four oxygen atoms in an individual chemical compound.

The second oxygen donor may be miscible in water.

The second oxygen donor may have a flash point, measured according to ASTM D93, of from 55° C. to 115°.

The second oxygen donor may have a flash point, measured according to ASTM D93, of at least 60° C., or may have a flash point, measured according to ASTM D93, of at least 65° C., or may have a flash point, measured according to ASTM D93, of at least 70° C., or may have a flash point, measured according to ASTM D93, of at least 75° C., or may have a flash point, measured according to ASTM D93, of 75° C.

The second oxygen donor may be selected from the group comprising: di(propylene glycol) methyl ether, cyclopentanone, 1-butoxy-2-propanol, 3-octanone, 2-butoxyethan-1-ol, dipropylene glycol monomethyl ether, 1-phenylethan-1-one, diethyl butanedioate, 2-(2-methoxyethoxy) ethanol, 2-(2-ethoxyethoxy) ethanol, and 2-(2-butoxyethoxy) ethanol.

The second oxygen donor may comprise one or more of: di(propylene glycol) methyl ether, cyclopentanone, 1-butoxy-2-propanol, 3-octanone, 2-butoxyethan-1-ol, dipropylene glycol monomethyl ether, 1-phenylethan-1-one, diethyl butanedioate, 2-(2-methoxyethoxy) ethanol, 2-(2-ethoxyethoxy) ethanol, or 2-(2-butoxyethoxy) ethanol.

The second oxygen donor may comprise di(propylene glycol) methyl ether.

The second oxygen donor may be selected from the group consisting of: di(propylene glycol) methyl ether, cyclopentanone, 1-butoxy-2-propanol, 3-octanone, 2-butoxyethan-1-ol, dipropylene glycol monomethyl ether, 1-phenylethan-1-one, diethyl butanedioate, 2-(2-methoxyethoxy) ethanol, 2-(2-ethoxyethoxy) ethanol, and 2-(2-butoxyethoxy) ethanol.

The second oxygen donor may be di(propylene glycol) methyl ether, or may consist of di(propylene glycol) methyl ether.

The hydrocarbon may comprise respective first and second hydrocarbons. The first hydrocarbon may comprise an individual chemical compound, or may comprise a plurality of different chemical compounds. The second hydrocarbon may comprise an individual chemical compound, or may comprise a plurality of different chemical compounds.

The lubricant may have a flash point, measured according to ASTM D93, of up to 80° C., or of up to 70° C., or of up to 65° C. The lubricant may have a flash point, measured according to ASTM D93, of less than 70° C., or of less than 65° C. The lubricant may have a flash point, measured according to ASTM D93, of from 20° C. to 80° C., or from 20° C. to 70° C., or from 30° C. to 70° C.

The lubricant may be selected from the group comprising: kerosene, odourless kerosene, mineral oil, white spirits, hydrodesulphurized heavy naphtha (petroleum), solvent-refined heavy naphtha (petroleum), hydrotreated heavy naphtha (petroleum), hydrocarbons $C_9$-$C_{11}$ isoalkanes, hydrocarbons $C_{10}$-$C_{12}$, isoalkanes, and hydrocarbons $C_{11}$-$C_{12}$, isoalkanes.

The lubricant may comprise one or more of: kerosene, odourless kerosene, mineral oil, white spirits, hydrodesulphurized heavy naphtha (petroleum), solvent-refined heavy naphtha (petroleum), hydrotreated heavy naphtha (petroleum), hydrocarbons $C_9$-$C_{11}$ isoalkanes, hydrocarbons $C_{10}$-$C_{12}$, isoalkanes, or hydrocarbons $C_{11}$-$C_{12}$, isoalkanes.

The lubricant may comprise odourless kerosene.

The lubricant may be selected from the group consisting of: kerosene, odourless kerosene, mineral oil, white spirits, hydrodesulphurized heavy naphtha (petroleum), solvent-refined heavy naphtha (petroleum), hydrotreated heavy naphtha (petroleum), hydrocarbons $C_9$-$C_{11}$ isoalkanes, hydrocarbons $C_{10}$-$C_{12}$, isoalkanes, and hydrocarbons $C_{11}$-$C_{12}$, isoalkanes.

The lubricant may be odourless kerosene, or may consist of odourless kerosene.

The aromatic hydrocarbon may comprise C10 aromatic hydrocarbon blend.

The composition may comprise hydrocarbon and oxygen donor in a ratio of from 5:5 to 7:3, or may comprises hydrocarbon and oxygen donor in a ratio of 6:4.

The composition may comprise 50 to 70% by volume hydrocarbon, or may comprise 60% by volume hydrocarbon. The composition may comprise 40 to 60% by volume aromatic hydrocarbon, or may comprise 50% by volume aromatic hydrocarbon. The composition may comprise 5 to 15% by volume lubricant, or may comprise 10% by volume lubricant.

The composition may comprise 30 to 50% by volume oxygen donor, or may comprise 40% by volume oxygen donor. The composition may comprise 10 to 30% by volume of the first oxygen donor, or may comprise 20% by volume of the first oxygen donor. The composition may comprise 10 to 30% by volume of the second oxygen donor, or may comprise 20% by volume of the second oxygen donor.

The composition may comprise a biocide. The biocide may comprise Methylisothiazolinone. The biocide may comprise a mixture of Methylisothiazolinone and Chloromethylisothiazolinone. The composition may comprise 0.015 to 6% by volume biocide, or may comprise 0.05 to 2% by volume biocide, or may comprise 0.05 to 1% by volume biocide.

Possibly, the lubricant comprises odourless kerosene and the aromatic hydrocarbon comprises 010 aromatic hydrocarbon blend; and the first oxygen donor comprises benzyl alcohol and the second oxygen donor comprises dipropylene glycol monomethyl ether; and wherein the composition may have a flash point, measured according to ASTM D93, of greater than 63° C.

The composition may comprise 10% by volume odourless kerosene, 50% by volume 010 aromatic hydrocarbon blend, 20% by volume benzyl alcohol, and 20% by volume dipropylene glycol monomethyl ether.

According to various, but not necessarily all, examples of the disclosure there is provided a method of cleaning a combustion engine system, wherein the method comprises:

passing a composition into an engine of the combustion engine system, wherein the composition is according to any of the preceding paragraphs.

In some examples, the composition may be passed directly into the engine. In other examples, the composition may be introduced into the fuel tank and be passed into the engine from the fuel tank.

According to various, but not necessarily all, examples of the disclosure there may be provided examples as claimed in the appended claims.

BRIEF DESCRIPTION

For a better understanding of various examples that are useful for understanding the detailed description, reference will now be made by way of example only.

DETAILED DESCRIPTION

A composition for cleaning a combustion engine system is described, wherein the composition comprises a hydrocarbon and an oxygen donor.

The hydrocarbon comprises respective first and second hydrocarbons. The first hydrocarbon comprises a lubricant, wherein the lubricant has a flash point, measured according to ASTM D93, of less than 80° C. The second hydrocarbon comprises an aromatic hydrocarbon, wherein the aromatic hydrocarbon has a flash point, measured according to ASTM D93, of greater than 62° C.

The oxygen donor comprises respective first and second oxygen donors. The first oxygen donor comprises a hydroxyl group and has a flash point, measured according to ASTM D93, of from 45° C. to 95° C. The second oxygen donor comprises a carbonyl group or an ether group and has a flash point, measured according to ASTM D93, of from 50° C. to 120° C.

Advantageously, the composition has a flash point, measured according to ASTM D93, of greater than 55° C.

One example of the disclosure is described in table 1 below.

EXAMPLE 1

| Component | Amount (% by volume) | Flash point |
|---|---|---|
| C10 aromatic hydrocarbon blend | 50 | >63° C . |
| Odourless kerosene | 10 | 37-65° C. |
| Benzyl alcohol | 20 | 93° C. |
| Dipropylene glycol monomethyl ether | 20 | 75° C. |

The composition of example 1 has a flash point, measured according to ASTM D93, of greater than 63° C.

The hydrocarbon in example 1 comprises a first and a second hydrocarbon. The first hydrocarbon is odourless kerosene and the second hydrocarbon is C10 aromatic hydrocarbon blend.

C10 aromatic hydrocarbon blend is an aromatic hydrocarbon. In example 1 above, the 010 aromatic hydrocarbon blend is BAS150® (CAS number 64742-94-5). In other examples, the 010 aromatic hydrocarbon may be any of: Solvent Naphtha, Shellsol 150®, Atosol 150®, Solvesso 150®, Aromatic Solvent 010 or Kocosol 150®, or any other 010 aromatic hydrocarbon blend.

Odourless kerosene acts as a lubricant, i.e. odourless kerosene is a lubricant.

The oxygen donor of example 1 comprises a first and a second oxygen donor. The first oxygen donor comprises benzyl alcohol and the second oxygen donor comprises dipropylene glycol monomethyl ether. Benzyl alcohol is an aromatic alcohol and therefore comprises a hydroxyl group and an aromatic group. Dipropylene glycol monomethyl ether comprises a hydroxyl group and an ether group.

In some examples, kerosene may be dearomatized. In other examples, kerosene may comprise aromatic structures. Odourless kerosene may be desulphurised. The flash point of kerosene is estimated to be over 62° C. with no definitive upper limit, but generally likely to be no more than 80° C. Kerosene may be a mixture of saturated hydrocarbons varying in carbon chain length from $C_7$ to $C_{18}$ (or in some examples from $C_{12}$ to $C_{16}$). In some examples, the carbon chain is branched, or straight chained (aliphatic), or cyclic (cycloalkanes). In other examples, the carbon chain comprises aromatic structures, for example, benzene and derivatives thereof.

To clean a combustion engine system, a composition according to examples of the disclosure is passed into an engine of the combustion engine system.

The combustion engine system may comprise a two or four stroke engine, and may be used, for example, to power vehicles such as cars or boats or other machines such as lawnmowers.

In some examples, the composition is passed directly into the engine. In such examples, the fuel line to the engine is disconnected and the engine is connected to a means for passing the composition directly into the engine.

In other examples, the composition is introduced into the fuel tank and is passed into the engine from the fuel tank. In such examples, the fuel tank may already contain a quantity of fuel. The amount of composition added is predetermined by the quantity of fuel contained in the tank, and wherein the amount of composition added is in the range of 0.5 to 0.75 litres per 15 litres of fuel. In use, the composition passes into the engine through the fuel injection system during normal operation of the combustion engine system.

From the engine, the combustion products of the composition pass through the catalytic converter and out through the exhaust system. It is understood that the composition generates an organic acid vapour on combustion in the engine, for example, which comprises a carboxylic acid vapour.

It has been found that compositions according to the disclosure used as described above improve performance of, and decrease emissions from, combustion engine systems.

Combustion engine systems are commonly used to power vehicles and other machines. In some examples, a combustion engine system comprises a fuel storage system, an internal combustion engine, a fuel injection system for introduction of fuel into the engine, a catalytic converter, and an exhaust system.

It is understood that compositions according to the disclosure improve performance of, and decrease emissions from, combustion engine systems by reducing or removing deposits from, for example, the fuel storage system, the internal combustion engine, the fuel injection system for introduction of fuel into the engine, the catalytic converter, and/or the exhaust system.

It is understood that a contributing factor in the removal or reduction of deposits from the catalytic converter and exhaust system is the action of the organic acid vapour which results from the combustion of the composition in the engine.

The flash point of a volatile material is the lowest temperature at which the material will ignite, when given an ignition source. Accordingly, flash point is used as a measure to classify whether a volatile material is flammable, highly flammable or extremely flammable.

The correspondence between flash point and flammability classification may differ depending on the jurisdiction and regulatory code of practice. However, the lower the flash point, the more flammable the liquid.

By way of example only, in one such regulatory code of practice 'Extremely flammable' liquids have a flash point lower than 0° C., 'Highly flammable' liquids have a flash point below 21° C. (but which are not extremely flammable), and flammable liquids have a flash point equal to or greater than 21° C. and less than or equal to 55° C.

By way of example only, in another such regulatory code of practice 'flammable' liquids have a flash point equal to or greater than 23° C. and less than or equal to 60° C. in the occupational safety and health administration's (OSHA's) hazard communication standard. Above 60° C., a liquid is classified as 'combustible' in this standard, which is a category 4 liquid.

A composition having a flash point, measured according to ASTM D93, of greater than, for example, 55° C. covers compositions having a flash point greater than 55° C. Accordingly, a composition having a flash point, measured according to ASTM D93, of greater than 60° C. covers compositions having a flash point greater than 60° C.

By the above measure, compositions according to the disclosure are not classified as 'flammable', 'highly flammable' or 'extremely flammable', but in some codes of practice are instead classified as 'combustible liquids'. Accordingly, such compositions are significantly less hazardous to use and less problematic to transport and store than known compositions which are classified as 'flammable', 'highly flammable' or 'extremely flammable'. However, use of compositions according to examples of the disclosure results in a broadly similar or improved reduction in emissions and improvement in performance over existing compositions.

In known compositions the oxygen donor comprises low flash point solvents such as acetone (first oxygen donor) and isopropyl alcohol (second oxygen donor). Accordingly, such known compositions have a relatively low flash point, and are therefore hazardous to use and problematic to transport and store.

Example first oxygen donors of the present disclosure have a relatively higher flash point than known first oxygen donors, but have a comparable solvency.

Solvency power is typically measured by the Kauri-Butanol Value (KB value) of the solvent. The KB value is a measure of solvency power whereby the higher the KB value, the higher the solvency power.

Example second oxygen donors of the present disclosure have a relatively higher flash point than known second oxygen donors, but have a comparable solubility in water.

Furthermore, in known compositions xylene may be used as an aromatic hydrocarbon. To further increase the flash point of the composition aromatic hydrocarbons with a higher flash point are used, for example, C10 aromatic hydrocarbon blend.

There is thus described a composition and method with a number of advantages as detailed above.

Although embodiments of the present invention have been described in the preceding paragraphs with reference to various examples, it should be appreciated that modifications to the examples given can be made without departing from the scope of the invention as claimed. For instance, each of the aromatic hydrocarbon, the lubricant, the first oxygen donor, and the second oxygen donor could be a mixture of different compounds, for example, selected from the groups specified.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that features described with reference to one example but not with reference to another example, can where possible be used in that other example but does not necessarily have to be used in that other example.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A composition for cleaning a combustion engine system, wherein the composition comprises:

a hydrocarbon, wherein the hydrocarbon comprises respective first and second hydrocarbons, wherein the first hydrocarbon comprises a lubricant, wherein the lubricant has a flash point, measured according to ASTM D93, of less than 80° C., wherein the lubricant comprises odourless kerosene, wherein the second hydrocarbon comprises an aromatic hydrocarbon, wherein the aromatic hydrocarbon has a flash point, measured according to ASTM D93, of greater than 62° C., wherein the aromatic hydrocarbon comprises C10 aromatic hydrocarbon blend; and an oxygen donor, wherein the oxygen donor comprises respective first and second oxygen donors, wherein the first oxygen donor comprises a hydroxyl group and has a flash point, measured according to ASTM D93, of from 45° C. to 95° C., wherein the first oxygen donor comprises benzyl alcohol, and wherein the second oxygen donor comprises a carbonyl group or an ether group and has a flash point, measured according to ASTM D93, of from 50° C. to 120° C., wherein the second oxygen donor comprises dipropylene glycol monomethyl ether.

2. A composition according to claim 1, wherein the first oxygen donor has from five to eight carbon atoms in an individual chemical compound.

3. A composition according to claim 1, wherein the hydroxyl group is a primary alcohol.

4. A composition according to claim 1, wherein the first oxygen donor has a flash point, measured according to ASTM D93, of from 50° C. to 93° C.

5. A composition according to claim 1, wherein the first oxygen donor comprises one or more of: 2-methylbutan-1-ol, 2-ethylbutan-1-ol, or 2-ethyl hexanol.

6. A composition according to claim 1, wherein the second oxygen donor has from five to eight carbon atoms in an individual chemical compound.

7. A composition according to claim 1, wherein the second oxygen donor has from one to four oxygen atoms in an individual chemical compound.

8. A composition according to claim 1, wherein the second oxygen donor has a flash point, measured according to ASTM D93, of from 55° C. to 115° C.

9. A composition according to claim 1, wherein the second oxygen donor comprises one or more of: cyclopentanone, 1-butoxy-2-propanol, 3-octanone, 2-butoxyethan-1-ol, 1-phenylethan-1-one, diethyl butanedioate, 2-(2-methoxyethoxy) ethanol, 2-(2-ethoxyethoxy) ethanol, or 2-(2-butoxyethoxy) ethanol.

10. A composition according to claim 1, wherein the lubricant has a flash point, measured according to ASTM D93, of less than 70° C.

11. A composition according to claim 1, wherein the lubricant comprises one or more of: kerosene, mineral oil, white spirits, $C_9$-$C_{11}$ isoalkanes, $C_{10}$-$C_{12}$ isoalkanes, or $C_{11}$-$C_{12}$ isoalkanes.

12. A composition according to claim 1, wherein the composition comprises hydrocarbon and oxygen donor in a volume ratio of from 5:5 to 7:3.

13. A composition according to claim 1, wherein the composition comprises hydrocarbon and oxygen donor in volume a ratio of 6:4.

14. A composition according to claim 1, wherein the composition comprises a biocide.

15. A composition according to claim 1, wherein the composition has a flash point, measured according to ASTM D93, of greater than 55° C.

16. A composition according to claim 1, wherein the composition comprises 10% by volume odourless kerosene, 50% by volume C10 aromatic hydrocarbon blend, 20% by volume benzyl alcohol, and 20% by volume dipropylene glycol monomethyl ether.

17. A composition according to claim 1, wherein the composition has a flash point, measured according to ASTM D93, of greater than 63° C.

18. A method of cleaning a combustion engine system, wherein the method comprises:

passing a composition into an engine of the combustion engine system, wherein the composition is according to claim 1.

* * * * *